US009429872B2

(12) United States Patent
Nakajima

(10) Patent No.: US 9,429,872 B2
(45) Date of Patent: Aug. 30, 2016

(54) IMAGE FORMING APPARATUS

(71) Applicant: CANON KABUSHIKI KAISHA, Tokyo (JP)

(72) Inventor: Takao Nakajima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/132,191

(22) Filed: Dec. 18, 2013

(65) Prior Publication Data

US 2014/0169835 A1 Jun. 19, 2014

(30) Foreign Application Priority Data

Dec. 19, 2012 (JP) ..... 2012-277135

(51) Int. Cl.
*G03G 15/08* (2006.01)

(52) U.S. Cl.
CPC ..... *G03G 15/0874* (2013.01)

(58) Field of Classification Search
USPC ..... 399/255, 262
See application file for complete search history.

(56) References Cited

U.S. PATENT DOCUMENTS

2006/0104672 A1* 5/2006 Yoshino et al. ..... 399/262
2010/0021213 A1* 1/2010 Okamoto et al. ..... 399/262
2011/0311242 A1* 12/2011 Tanda ..... 399/27
2012/0014722 A1* 1/2012 Okino ..... G03G 15/0867 399/262
2012/0177414 A1* 7/2012 Ikeguchi et al. ..... 399/262

FOREIGN PATENT DOCUMENTS

JP 2011-095317 A 5/2011
JP 2011-123449 A 6/2011

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

An image forming apparatus includes an image forming station having an image bearing member for bearing a latent image and a developing device for developing the latent image formed on the image bearing member using toner, a toner container for accommodating toner to be supplied to the developing device, the toner container being provided with an expansion-and-contraction portion capable of being expanded and contracted in a longitudinal direction thereof by being driven, and a holding member for holding the toner container. In addition, a first side plate supports one end portion of the holding member, a second side plate supports the other end portion of the holding member, and a driving device drives the image forming station. The holding member is supported by the first side plate so as to be movable relative to the first side plate in the longitudinal direction and is fixed to the second side plate.

18 Claims, 12 Drawing Sheets

IMAGE FORMING APPARATUS

FIELD OF THE INVENTION AND RELATED ART

The present invention relates to an image forming apparatus (printer, copying machine, facsimile machine, etc.) which uses an electrophotographic image forming method or an electrostatic recording method.

Image forming apparatuses which use an electrophotographic image forming method or the like, form an image by forming an electrostatic image on their image bearing member, and developing this electrostatic image with the use of their developing device which uses developer. Thus, their developing device has to be supplied with developer as necessary. Therefore, some of these image forming apparatuses and developer containers therefor are structured so that the developer container is removably installable into their main assembly, in order to make it possible for the developer container in their main assembly to be replaceable with a replacement (brand-new) developer container as the developer container in the main assembly runs out of developer.

As for the means for delivering the developer in a developer container to a developing device, the main assembly of an image forming apparatus is provided with a driving device, from which mechanical driving force is transmitted to the developing device to cause the developer container to rotationally move or in the similar motion. Generally speaking, however, as a developer container is rotated, it is liable to vibrate.

One of the means for preventing these vibrations attributable to the operation for supplying a developing device with the developer from a developer container, from being transmitted to a developer container holding member, is disclosed in Japanese Laid-open Patent Application 2011-95317, which proposes to place a floating member between a developer container and an image formation station, in the main assembly of an image forming apparatus.

However, even if an electrophotographic image forming apparatus is structured so that the vibrations attributable to the operation for delivering developer from a developer container to a developing device are prevented from transmitting to a developer container holding member, the vibrations sometime travel to the developer container holding member, and then, from the holding member to various elements of the image forming means, a driving device which transmits mechanical driving force to the image forming means. This transmission of vibrations to the image forming means sometimes results in the formation of an unsatisfactory image by an image forming apparatus.

SUMMARY OF THE INVENTION

Thus, the primary object of the present invention is to provide an image forming apparatus which can prevent the vibrations attributable to the driving of a developer container, from traveling to the image forming means of the image forming apparatus, and the driving device of the image forming apparatus, which transmits driving force to the image forming means.

The above-described object can be accomplished by an image forming apparatus in accordance with the present invention. In essence:

According to an aspect of the present invention, there is provided an image forming apparatus comprising an image forming station including an image bearing member for bearing a latent image and a developing device for developing the latent image formed on said image bearing member, using toner; a toner container for accommodating toner to be supplied to said developing device, said toner container being provided with an expansion-and-contraction portion capable of being expanded and contracted in a longitudinal direction thereof by being driven; a pair of side plates opposing to each other; holding members, provided on said side plates, respectively, for holding said toner container; a drive transmission mechanism for transmitting a drive to said image forming station, wherein said drive transmission mechanism is provided on one of said side plates, and wherein said holding member is mounted to said one of said side plates so as to be movable in the longitudinal direction is fixed to the other side plate.

Further features of the present invention will become apparent from the following description of exemplary embodiments (with reference to the attached drawings).

DESCRIPTION OF THE PREFERRED EMBODIMENTS

Hereinafter, an image forming apparatus in accordance with the present invention is described in detail with reference to the appended drawings.

Embodiment 1

Figure 1:
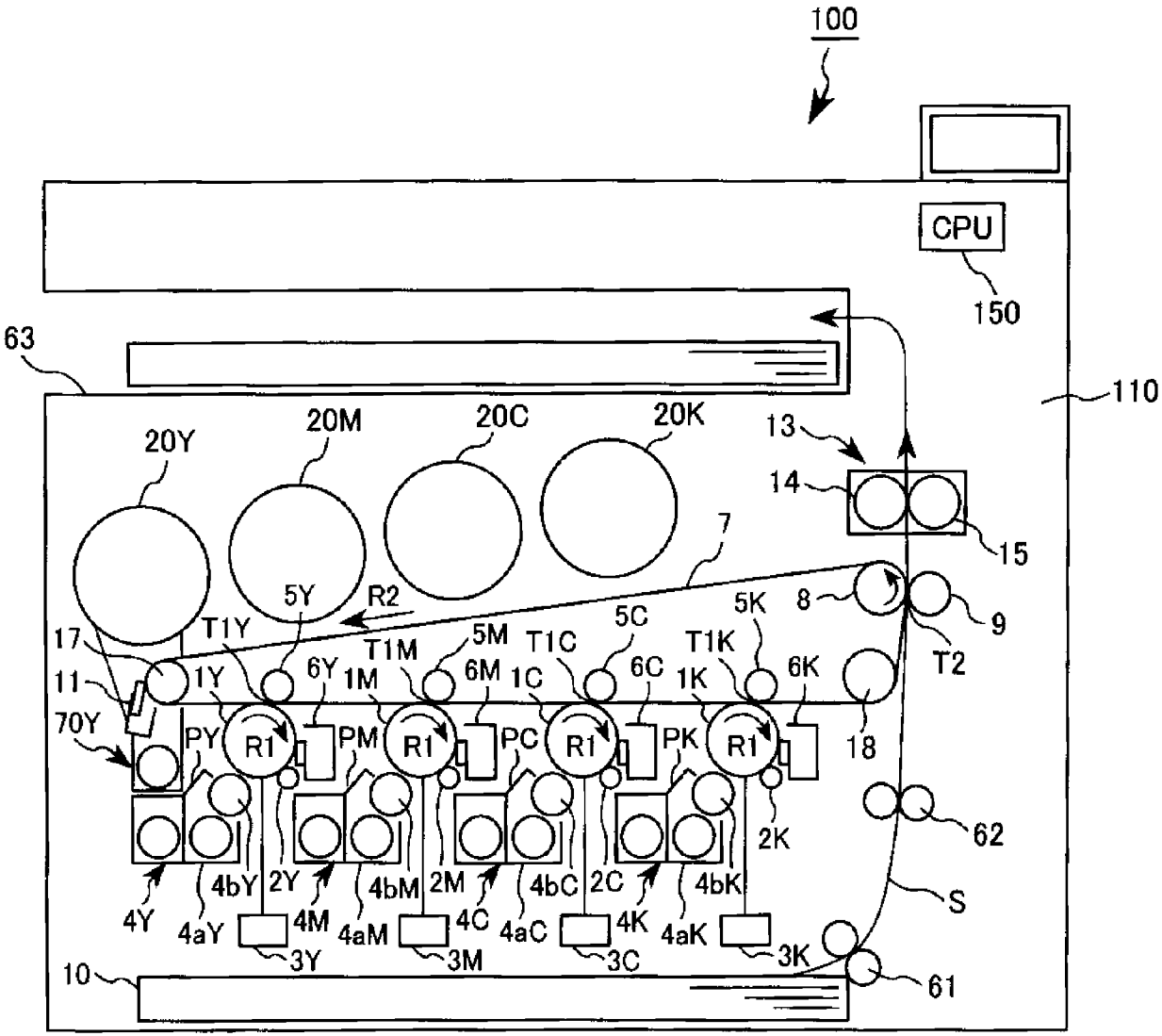
FIG. 1 is a schematic sectional view of the image forming apparatus in one of the embodiments of the present invention.

To begin with, the image forming apparatus in the first embodiment of the present invention is described about its overall structure and operation. FIG. 1 is a schematic sectional view of the image forming apparatus 100 in this embodiment.

The image forming apparatus 100 is a color image forming apparatus capable of forming a full-color image with the use of an electrophotographic image forming method. This image forming apparatus 100 is of the so-called intermediary transfer type, and also, of the so-called tandem type. That is, it has multiple image forming means, more specifically, the first, second, third, and fourth image formation stations PY, PM, PC and PK, and an intermediary transfer belt 7. It is structured so that the first to fourth image formation stations P are aligned along the intermediary transfer belt 7 in the direction parallel to the moving direction of the intermediary transfer belt 7. The image formation stations PY, PM, PC and PK form yellow (Y), magenta (M), cyan (C) and black (K) images, respectively.

By the way, in this embodiment, the first, second, third, and fourth image formation stations PY, PM, PC and PK, respectively, are practically the same in structure and operation, although they are different in the color of the toner which they use. Therefore, unless they need to be differentiated, the suffixes Y, M, C and K, which indicate the color of the image which each four image formation station forms, are not shown. That is, all four image formation stations are described as an image formation station P.

Regarding the orientation of the image forming apparatus 100, the front (front surface) of the image forming apparatus 100 means the front side of the image forming apparatus 100 in terms of the direction perpendicular to the surface of a sheet of paper, on which FIG. 1 is present. The rear (rear surface) means the rear side of the image forming apparatus 100 with reference to the direction perpendicular to the sheet of paper on which FIG. 1 is present. Ordinarily, the front side of the image forming apparatus 100 in this embodiment is the side of the image forming apparatus 100, from which the image forming apparatus 100 is to be operated, In particular, the image forming apparatus 100 in this embodiment is structured so that a toner container (bottle) 20 (which will be described later) is to be installed into, or from, the image forming apparatus 100 from the front side of the apparatus 100. Also regarding the orientation of the image forming apparatus 100, the top and bottom sides of the image forming apparatus 100 are the top and bottom sides of the image forming apparatus 100 when the apparatus 100 is in such an attitude that allows the apparatus 100 to normally operate. Further, the left and right sides of the image forming apparatus 100 are the left and right sides of the apparatus 100 as seen from the front side of the apparatus 100 when the apparatus is ready for an image forming operation.

The image formation station P has an electrophotographic photosensitive member (photosensitive member) 1, as an image bearing member, which is in the form of a drum. The photosensitive drum 1 is rotationally driven in the direction indicated by an arrow mark R1 by the mechanical driving force transmitted to the photosensitive drum 1 from a motor (FIG. 2), as the mechanical driving force source, of an image forming means driving device 90 as the first driving device. The image formation station P is also provided with various means for processing the photosensitive drum 1, which are in the adjacencies of the peripheral surface of the photosensitive drum 1, being sequentially arranged in the rotational direction of the photosensitive drum 1. The first processing means is the charging means, as a charging member, which is a charge roller (charging device) 2. The next one is an exposing device (laser scanner) 3 as an exposing means (image writing means). The next one is a developing device 4 as a developing means. The next one is a primary transfer roller (primary transferring device) 5 as the primary transferring means. The next one is a photosensitive member cleaner 6 as a photosensitive member cleaning means.

Further, the image forming apparatus 100 is provided with an intermediary transfer belt 7 (intermediary transferring member) which is in the form of an endless belt, and is disposed so that it opposes the photosensitive drum 1 of each image forming station P, being enabled to be placed in contact with the photosensitive drum 1. The intermediary transfer belt 7 is attached to an unshown intermediary transfer belt frame. More specifically, it is suspended, and kept tensioned, by an inside secondary transfer roller 8 (which doubles as means for transferring driving force to intermediary transfer belt 7), a tension roller 17, and an upstream secondary transfer roller 18, and is rotationally driven in the direction indicated by an arrow mark R2. Further, there are disposed four primary transfer rollers 5, on the inward side of the loop (belt loop) which the intermediary transfer belt 7 forms. The four primary transfer rollers 5 oppose the four photosensitive drums 1, one for one, being pressed against the four photosensitive drums 1 one for one, with the placement of the intermediary transfer belt 7 between the photosensitive drums 1 and primary transfer rollers 5, one for one. Each primary transfer roller 5 is pressed against the peripheral surface of the corresponding photosensitive drum 1, with the presence of the intermediary transfer belt 7 between the roller 5 and photosensitive drum 1. Thus, the primary transfer station (primary transfer nip) T1 is formed between the photosensitive drum 1 and intermediary transfer belt 7. Further, there is disposed a secondary transfer roller (secondary transferring device) 9, as the outside secondary transferring member, which is in the form of a roller. The outside secondary transfer roller 9 is kept pressed against the inside secondary transfer roller 8, with the presence of the intermediary transfer belt 7 between the outside and inside secondary transfer rollers 9 and 8, respectively, forming a secondary transfer station (secondary transfer nip) T2 between the outside secondary transfer roller 9 and intermediary transfer belt 7.

During an image forming operation, as the photosensitive drum 1 is rotationally driven, its peripheral surface is uniformly charged by the charge roller 2. Meanwhile, electrical signals generated based on the information of the image to be formed are sent to the image forming apparatus 100, and the exposing device 3 is driven to output a beam of light while modulating the beam of light with the electrical signals. The outputted beam of light is projected upon the uniformly charged portion of the peripheral surface of the photosensitive drum 1 by way of a light reflecting means, in a manner to scan the uniformly charged portion of the peripheral surface of the photosensitive drum 1. Consequently, an electrostatic latent image (electrostatic image) of the image to be formed is effected on the peripheral surface of the photosensitive drum 1.

Figure 2:
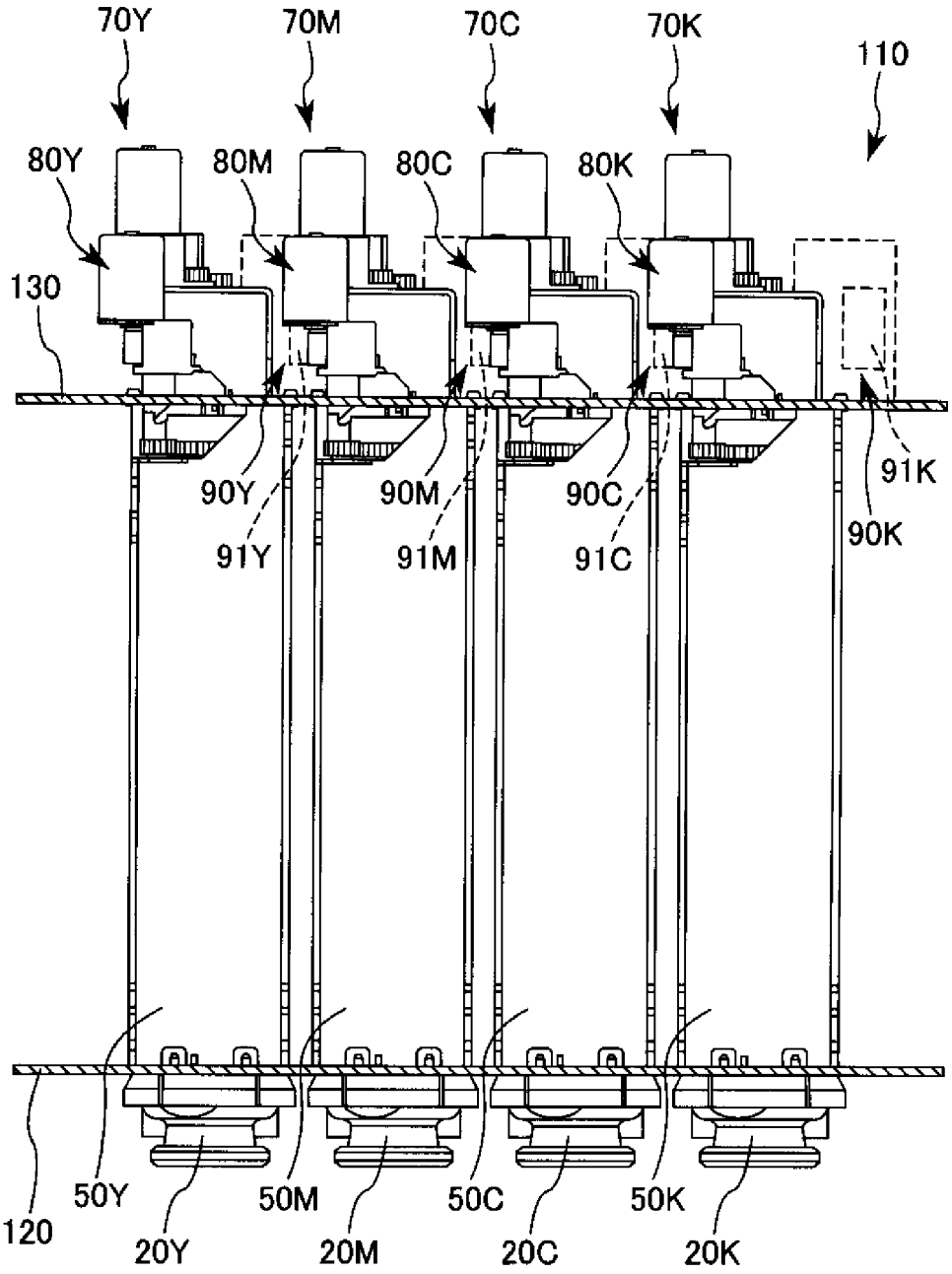
FIG. 2 is a top view of the developer container holding member of the image forming apparatus in the embodiment, when a toner container is in the holding member.

Then, the electrostatic latent image on the photosensitive drum 1 is developed by a combination of the developing device 4 and developer, into a visible image, that is, an image formed of toner (toner image, hereafter). In this embodiment, the developing device 4 has a developer container 4*a*, a development sleeve 4*b* (developer bearing member), etc. When the developer container 4*a* is brand-new, it is full of two-component developer (mixture of nonmagnetic toner and magnetic carrier) with which it is filled in advance. The developing devices 4Y, 4M, 4C and 4K in the first, second, third, and fourth image formation stations PY, PM, PC and PK contain yellow (Y), magenta (M), cyan (C) and black (K) toners, respectively. The developing device 4 conveys the developer in the developer container 4*a*, with the use of its development sleeve 4*b*, to a development area where the peripheral surface of the photosensitive drum 1 faces the peripheral surface of its development sleeve 4*b*, and supplies the peripheral surface of the photosensitive drum 1 with the toner in the developer, in a pattern of the electrostatic latent image on the photosensitive drum 1. In this embodiment, the electrostatic latent image is developed in reverse. That is, a toner image is formed by charging toner to the same polarity as the polarity (negative) to which the peripheral surface of the photosensitive drum 1 is charged, and adhering the toner to the exposed points of the peripheral surface of the photosensitive drum 1, that is, the points of the peripheral surface of the photosensitive drum 1, which have been charged, and then, reduced in potential in terms of absolute value, by the exposure. Also in this embodiment, the development sleeve 4*b* of the developing device 4 is rotationally driven by the driving force transmitted to the development sleeve 4*b* from the driving motor 91 (FIG. 2) which is the driving force source of the image forming means driving devices 90 (FIG. 2). That is, the image forming apparatus 100 in this embodiment is structured so that its image forming means driving device 90 delivers the mechanical driving force from its motor 91 to both the photosensitive drum 1, and the development sleeve 4*b* of the developing device 4, by way of the driving force transmitting member.

Then, the toner image on the photosensitive drum 1 is transferred (primary transfer) onto the intermediary transfer belt 7 by the function of the primary transfer roller 5, in the primary transfer station T1. More concretely, a preset electrostatic bias (load) is applied to the primary transfer roller 5 while the primary transfer roller 5 is kept pressed against the photosensitive drum 1, in order to transfer (primary transfer) the toner image on the photosensitive drum 1 onto the intermediary transfer belt 7.

After the primary transfer, a minute amount of toner (primary transfer residual toner) remaining on the peripheral surface of the photosensitive drum 1 is removed from the photosensitive drum 1 by the photosensitive member cleaner 6, and then, is recovered by the cleaner 6, so that the photosensitive drum 1 can be used for the next image formation process.

An image forming operation reduces the toner in the developing device 4. As the toner in the developing device 4 reduces, the developing device 4 is replenished with the toner from the toner container (developer container) 20Y, 20M, 20C or 20K in the image formation stations PY, PM, PC and PK, respectively, by the toner supplying devices 70Y, 70M, 70C or 70K, respectively (as developer supplying device). The toner delivery from the toner supplying device 70Y-70K to the developing device 4Y-4K, respectively, is carried out in synchronism with the driving of the developing device 4Y-4K, respectively. In this embodiment, the toner supplying devices 70Y, 70M, 70C and 70K are practically the same in structure. Thus, the toner supplying devices 70M, 70C and 70K in the second to third image formation stations PM, PC and PK, respectively, are not shown in FIG. 1. The operation of the toner supplying device 70 is described later.

During the formation of a full-color image, the above described image formation process is carried out in each of the first to fourth image formation stations PY, PM, PC and PK, with such a timing that, of the consecutively positioned two image formation stations P, the toner image formed in the downstream image formation station P, is transferred onto the intermediary transfer belt 7 in such a manner that it is layered upon the toner image having just been transferred (primary transfer) onto the intermediary transfer belt 7 by the upstream image formation station P. Consequently, a full-color image is effected on the intermediary transfer belt 7 by the multiple monochromatic toner images, different in color, layered on the intermediary transfer belt 7 as described above. This full-color image is conveyed to the secondary transfer station T2.

As for recording medium, multiple sheets S of recording medium are stored in layers in a recording medium storing means 10 which is in the form of a cassette or the like. The sheets S of recording medium in the recording medium storing means 10 are fed into the main assembly 110 of the image forming apparatus 100 one by one, in synchronism with the progression of the image formation in the image formation station P, by a pair of recording medium feeding rollers 61, which frictionally separate the topmost sheet S of recording medium in the recording medium storing means 10 from the rest. Then, each sheet S of recording medium is conveyed to a pair of registration rollers 62 through a recording medium conveyance passage. As it arrives at the pair of registration rollers 62, it is corrected in attitude and conveyance timing by the rollers 62, and then, sent to the secondary transfer station T2 with such a timing that the arrival of the sheet S at the secondary transfer nip T2 coincides with the arrival of the full-color toner image on the intermediary transfer belt 7 at the secondary transfer nip T2.

In the second transfer station T2, the toner image on the intermediary transfer belt 7 is transferred (secondary transfer) onto the sheet S of recording medium by the function of the outside secondary transfer roller 9. More specifically, the secondary transfer roller 9 forms a nip between itself and intermediary transfer belt 7 by being pressed against the inside secondary transfer roller 8, with the presence of the intermediary transfer belt 7 between itself and inside secondary transfer roller 8. As the sheet S of recording medium is conveyed through the secondary fixation station T2 while being subjected to the preset amount of internal pressure of the station T2, a preset bias (electrostatic bias) is applied to the outside secondary transfer 9. Consequently, the toner image on the intermediary transfer belt 7 is transferred (secondary transfer) onto the sheet S from the intermediary transfer belt 7.

The minute amount of toner (secondary transfer residual toner) remaining on the intermediary transfer belt 7 after the secondary transfer is removed by the intermediary transfer member cleaner 11, and then, is recovered by the cleaner 11.

Thereafter, the sheet S of recording medium having the transferred toner image (unfixed image) is conveyed to the fixing device 13, as a fixing means, which has a pair of rollers 14 and 15, which oppose each other. Then, the sheet S is conveyed through the fixation nip formed by the pair of rollers 14 and 15, while being subjected to a combination of a preset amount of pressure and a present amount of heat. Consequently, the unfixed toner image on the sheet S is thermally fixed to the sheet S of recording medium. The fixing device 13 is provided with a heater, and is controlled so that the temperature in the fixation nip remains at an optimal level for fixation.

After the fixation of the unfixed toner image to the sheet S of recording medium, the sheet S is discharged directly into the delivery tray 63. However, in a case where the image forming apparatus 100 is in the two-sided printing mode, the sheet S is sent to an unshown device for placing the sheet S upside down.

In this embodiment, the image forming apparatus 100 is structured so that the developing device 4 for each image formation station P is removably installable in the main assembly 110 of the image forming apparatus 100. Incidentally, a photosensitive drum, and at least one of processing means, more specifically, the charging means, developing means, and cleaning means, may integrally be placed in a cartridge (process cartridge) which is removably installable in the apparatus main assembly 110.

2. Toner Container

Next, the toner container 20 is described. In this embodiment, the toner cartridges 20Y, 20M, 20C and 20K are practically the same in structure (shape, function), although they are different in the color of the toner they contain.

FIG. 2 is a top view of the developer container holding members 50Y, 50M, 50C and 50K (which will be described later in detail), and toner containers 20Y, 20M, 20C and 20K when the toner container is in the holding member.

Referring to FIG. 2, the toner container 20 is removably installed into the toner container holding member 50, which is suspended between the front plate 120 and rear plate 130 (which will be described later in detail), by the front and rear plates 120 and 130, respectively. Also in this embodiment, in order to move the toner in the toner container 20, mechanical driving force is transmitted to the toner container 20 from the container driving device (toner supplying means driving device) 80 (FIG. 11) as the second driving device which will be described later in detail. The container driving device 80 transmits mechanical driving force to the toner container 20, in order to discharge the toner in the toner container 20 from the toner container 20, or stir the toner in the toner container 20. In this embodiment, the container driving device 80 rotationally drives the toner container 20 to make the toner container 20 discharge the toner in the toner container 20. Further, in this embodiment, at least a part of the toner container 20 is reciprocally driven in the lengthwise direction of the toner container 20, by the mechanical driving force transmitted from the container driving device 80.

In this embodiment, the lengthwise direction of the toner container 20 is parallel to the rotational axis of the toner container 20, and also, the toner conveyance direction of the toner container 20, that is, the direction in which the toner in the container 20 is conveyed in the container 20. When the toner container 20 is horizontally held by the toner container holding member 50 (which hereafter will be referred to simply as holding member), the lengthwise direction of the toner container 20 is roughly parallel to the axial line of the holding member 50, which extends between the front and rear plates 120 and 130, respectively.

Figure 3:
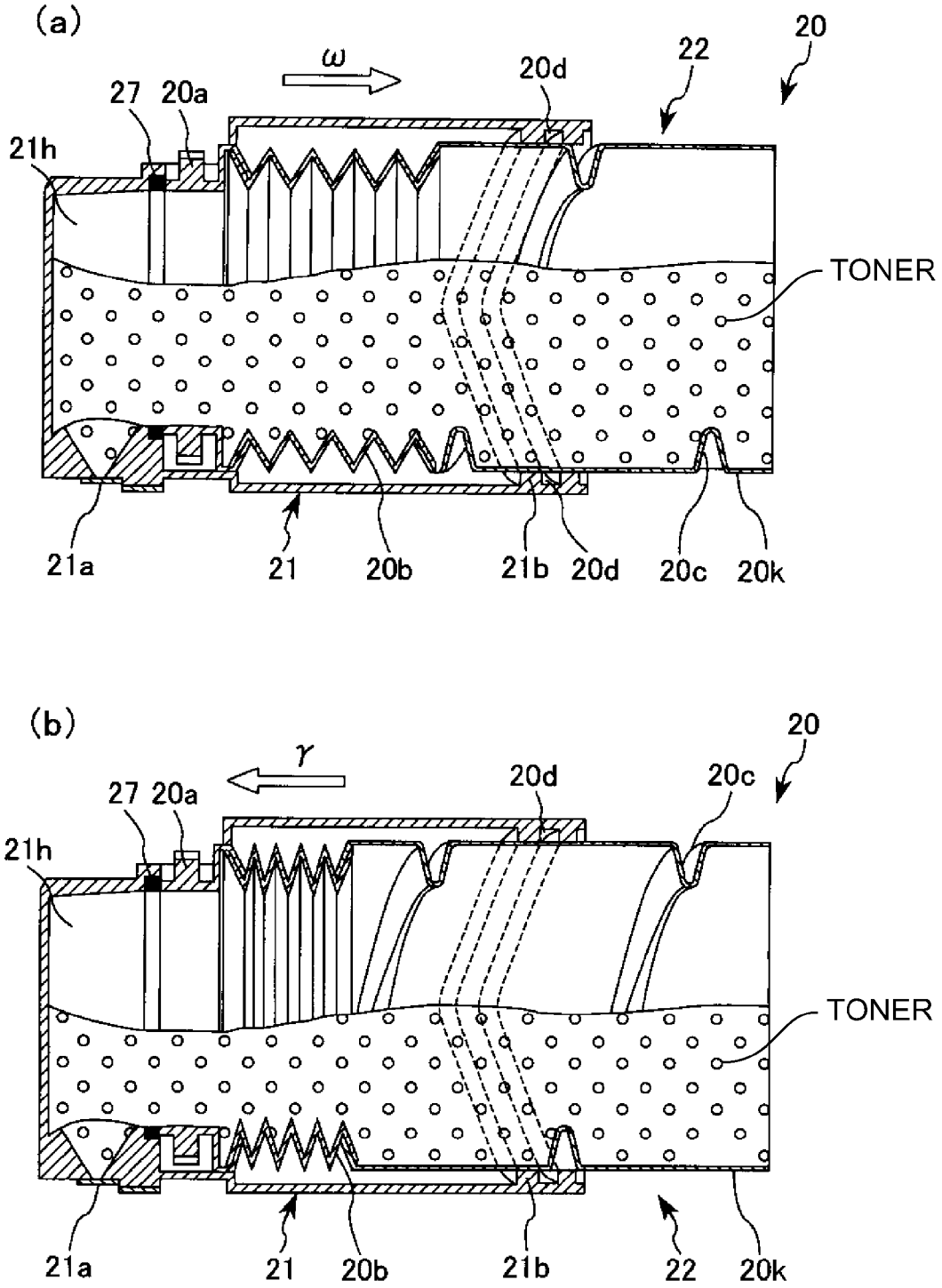
FIG. 3 is a schematic, and partially sectional, view of a part of the toner container in the embodiment.

FIG. 3 is an enlarged sectional view of the mechanically active portion of the toner container 20 in this embodiment. It is for showing the mechanically active portion in detail. Referring to FIG. 3, the toner container 20 has a toner storage portion (rotational portion) 22 which is roughly cylindrical and has an internal space in which toner can be stored. The toner container 20 has also a flange (non-rotational portion) 21, which is at one end of the toner storage portion 22 in terms of the lengthwise direction of the toner container 20. The toner storage portion 22 is rotatable relative to the flange portion 21.

The flange portion 21 has a toner discharging portion 21*h*, which is hollow and temporarily stores the toner conveyed thereto from the toner storage portion 22. The bottom portion of the discharging portion 21*h* has a small toner discharge hole 21*a*, which allows the toner in the toner container 20 to be discharged from the toner container 20, that is, to be delivered to the toner supplying device 70. The bottom portion of the discharging portion 21*h* is the portion of the discharging portion 21*h*, which will be at the bottom when the toner container 20 is being horizontally held by the holding member 50.

In terms of the lengthwise direction of the toner container 20, one end of the toner storage portion makes up a pumping portion (concertina portion) 20*b*, whereas the other end portion makes up a cylindrical portion 20*k*. The pumping portion 20*b* functions as a mechanism which alternately takes in the ambient air, and exhausts the air within the toner container 20, through the discharging hole 21*a*. The pumping portion 20*b* is between the discharging portion 21*h* and cylindrical portion 20*k*, and is fixed to the cylindrical portion 20*k*. Thus, the pumping portion 20*b* is rotatable together with the cylindrical portion 20*k*. Further, the pumping portion 20*b* also can store toner within itself. The pumping portion 20*b* employed in this embodiment is such a pump (concertina pump: pump of bellows type) that changes in internal space volume as it is reciprocally moved (alternately extended and contracted in direction indicated by arrow marks ω and γ, respectively, in FIG. 3). It is formed of a resinous substance. More concretely, referring to FIGS. 3(*a*) and 3(*b*), it is a pump of the so-called bellows type (concertina type). It is made up of inwardly folding pleats and outwardly folding pleats which are alternately positioned so that they align in the direction parallel to the axial line of the toner container 20. Further, the pumping portion 20*b* is fixed to the discharging portion 21*h* by its discharging portion side, in such a manner that the ring-shaped seal 27 fitted in the flange portion 21 in contact with the inward surface of the flange portion 21 remains compressed, and also, that the flange portion 21 is rotatable relative to the discharging portion 21*h*.

Further, the toner container 20 is provided with a gear portion 20*a* as a driving force receiving portion. This gear portion 20*b* is fixed to one of the lengthwise ends of the pumping portion 20*b*. Thus, the gear portion 20*a*, pumping portion 20*b*, and cylindrical portion 20*k* can be rotated together. That is, the image forming apparatus 100 is structured so that the rotational driving force inputted into the gear portion 20*a* is transmitted to the cylindrical portion 20*k* through the pumping portion 20*b*.

The inward surface of the flange portion 21 is provided with a cam groove 21*b*, in which cam protrusion 20*d* which protrudes from the peripheral surface of the cylindrical portion 20*k* of the toner container 20 fits. The cam groove 21*b* extends in a zigzag manner in the direction perpendicular to the rotational axis of the toner container 20. Next, this cam groove 21*b* is described with reference to FIG. 4, which is an elevation of the cam groove 21*b* in terms of the circumferential direction of the toner container 20.

Figure 4:
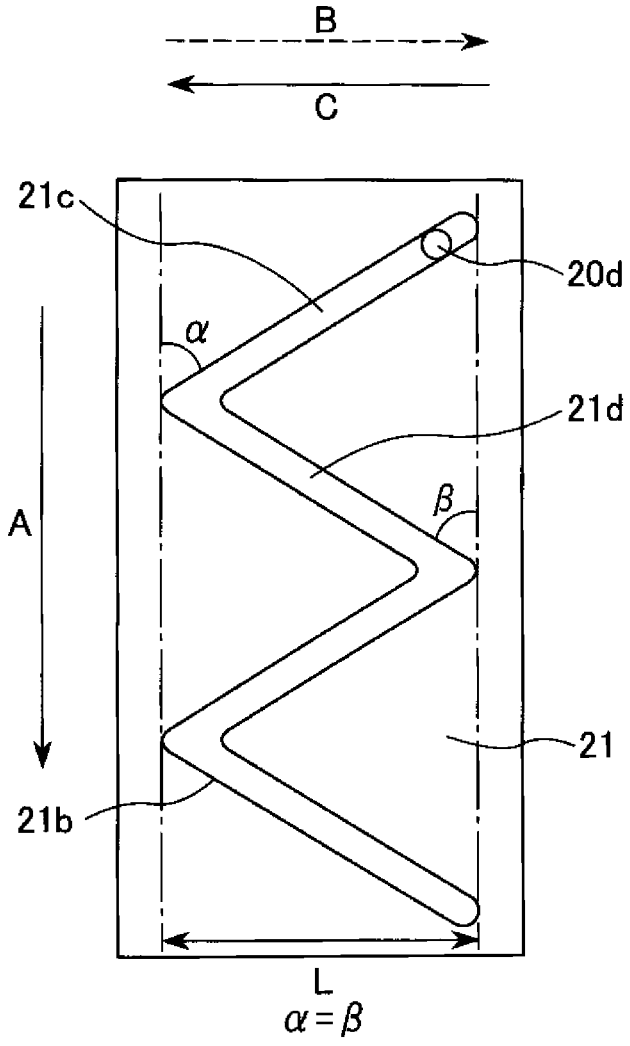
FIG. 4 is a schematic elevation of a part of the toner container in the embodiment.

Referring to FIG. 4, an arrow mark A indicates the rotational direction of the cylindrical portion 20*k* (moving direction of cam protrusion 20*d*), and an arrow mark B indicates the expansion direction of the pumping portion 20*b*. An arrow mark C indicates the contraction direction of the pumping portion 20*b*. Further, a letter α stands for the angle between the rotational direction A of the cylindrical portion 20*k* and the contractive side of the cam groove 21*c*, and a letter β stands for the angle between the rotational direction A of the cylindrical portion 20*k* and the expansive side of the cam groove 21*b*. Further, a letter L stands for the amplitude (=length of stroke of pumping portion 20*b*) of the pumping portion 20*b* in terms of the directions B and C in which the pumping portion 20 expands or contracts, respectively. More concretely, referring to FIG. 4, which is an elevation of the cam groove 21*b*, the cam groove 21*b* is made up of contractive portions 21*c* and expansive portions 21 which are alternately connected. The contractive portions 21*c* are those which are tilted downward from the cylindrical portion side to the discharging portion side, and the expansive portions 21*d* are those which are tilted downward from the discharging portion side to the cylindrical portion side. In this embodiment, $\alpha=\beta$. In this embodiment, therefore, the combination of the cam protrusion 20*d* and cam groove 21*b* functions as a driving force transmitting mechanism. That is, this combination of the cam protrusion 20*d* and cam groove 20*b* functions to convert the rotational driving force which the gear portion 20*a* receives, into such force (parallel to rotational axis of cylindrical portion 20*k*) that causes the pumping portion 20*b* to reciprocally move, and transmit the converted force to the pumping portion 20*b*.

Further, in this embodiment, the inward surface of the toner storage portion 22 (cylindrical portion 20*k*) of the toner container 20 is provided with a toner conveying portion 20*c* which protrudes toward the rotational axis of the toner container 20 by a preset height, and spirally extends in the direction parallel to the axial line of the toner container 20. That is, the developing device 4 is structured so that as the toner container 20 is rotationally driven, the toner conveying portion 20*c* (which hereafter will be referred to simply as conveying portion 20*c*) conveys the toner in the toner container 20 toward the pumping portion 20*b*, in the direction parallel to the rotational axis of the toner container 20.

As described above, in this embodiment, the toner in the toner container 20 is conveyed by the conveying portion 20*c* toward the pumping portion 20*b*, in the direction parallel to the axial line of the toner container 20, and then, is discharged from the toner container 20 through the discharging hole 21*b* by the exhaustion of the internal air of the toner container 20 caused by the alternate extension and contraction of the pumping portion 20*b*, as if it is pushed out of the toner container 20.

As described later in detail, in this embodiment, the toner container 20 is to be inserted into the holding member 50 from the front side of the image forming apparatus 100 in such an attitude that the flange portion 21 becomes the first portion of the toner container 20 that enters the holding portion 50.

3. Toner Container Holding Member

Next, the holding member 50 for holding the toner container 20 which contains the toner to be supplied to the developing device 4 is described. In this embodiment, the holding members 50Y, 50M, 50C and 50K are practically the same in structure (shape as well as function).

Referring to FIG. 2, the image forming apparatus 100 has the front and rear plates 120 and 130, as the first and second sub-frames, respectively, which are at the front and rear ends, respectively, of the apparatus 100. The front and rear plates 120 and 130 are made of a metallic substance. In this embodiment, the front and rear plates 120 and 130 are positioned so that they extend in parallel, roughly in the vertical direction, and oppose each other. The direction which is roughly perpendicular to the front and rear plates 120 and 130 is roughly parallel to the front-to-rear direction (depth direction) of the image forming apparatus 100. The depth direction of the image forming apparatus 100 is roughly parallel to the rotational axis of the photosensitive drum 1. The front and rear plates 120 and 130 function as parts of the boxy structure of the image forming apparatus 100, which provides the apparatus main assembly 110 with a part of its internal space, and also, function as members by which various elements, such as image forming means, of the image forming apparatus 100 are supported.

The holding member 50 is suspended between the front and rear plates 120 and 130. In this embodiment, the holding members 50Y, 50M, 50C and 50K are independently suspended, between the front and rear plates 120 and 130.

Figure 5:
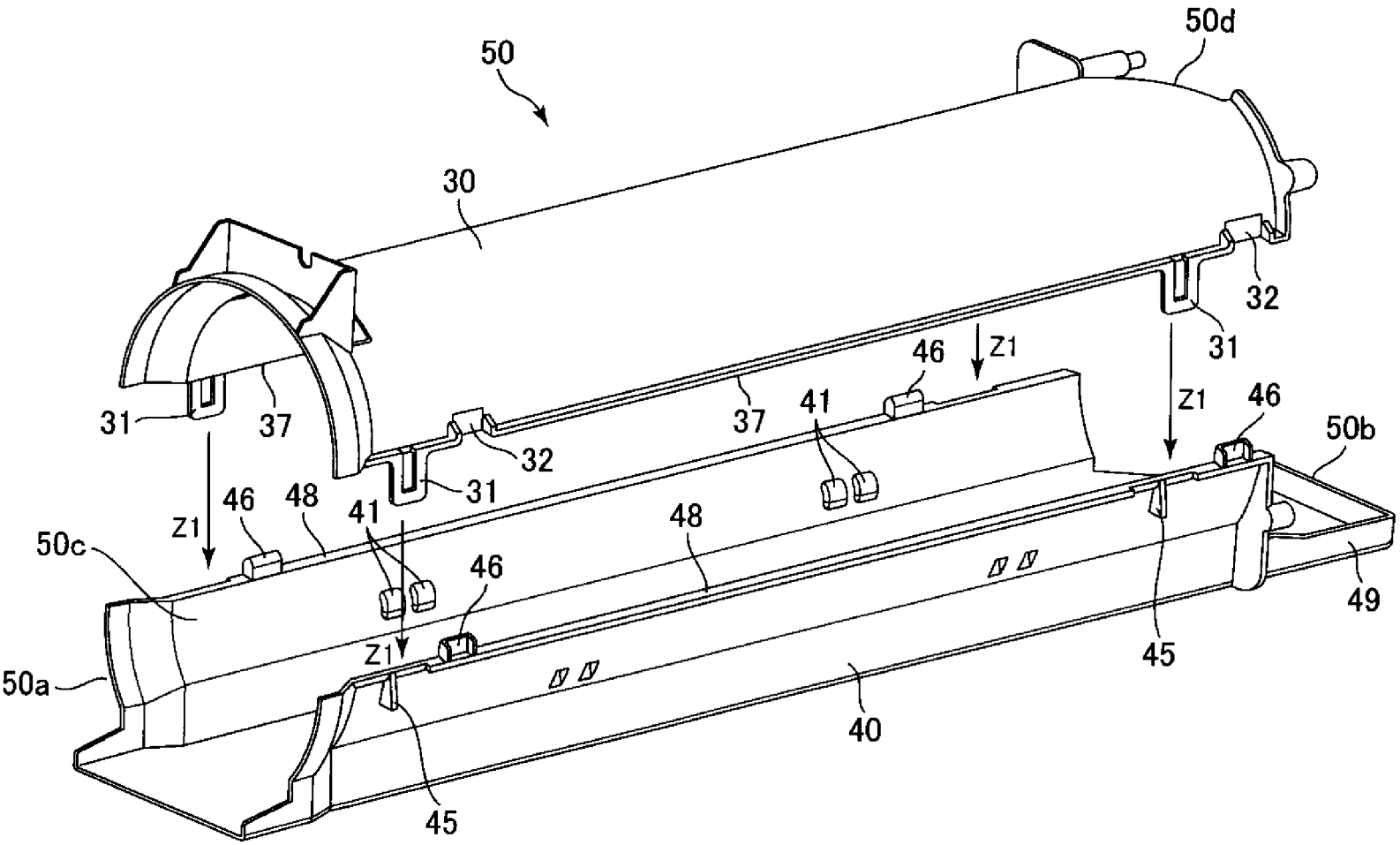
FIG. 5 is an exploded perspective view of the toner container holding member in the embodiment.
Figure 6:
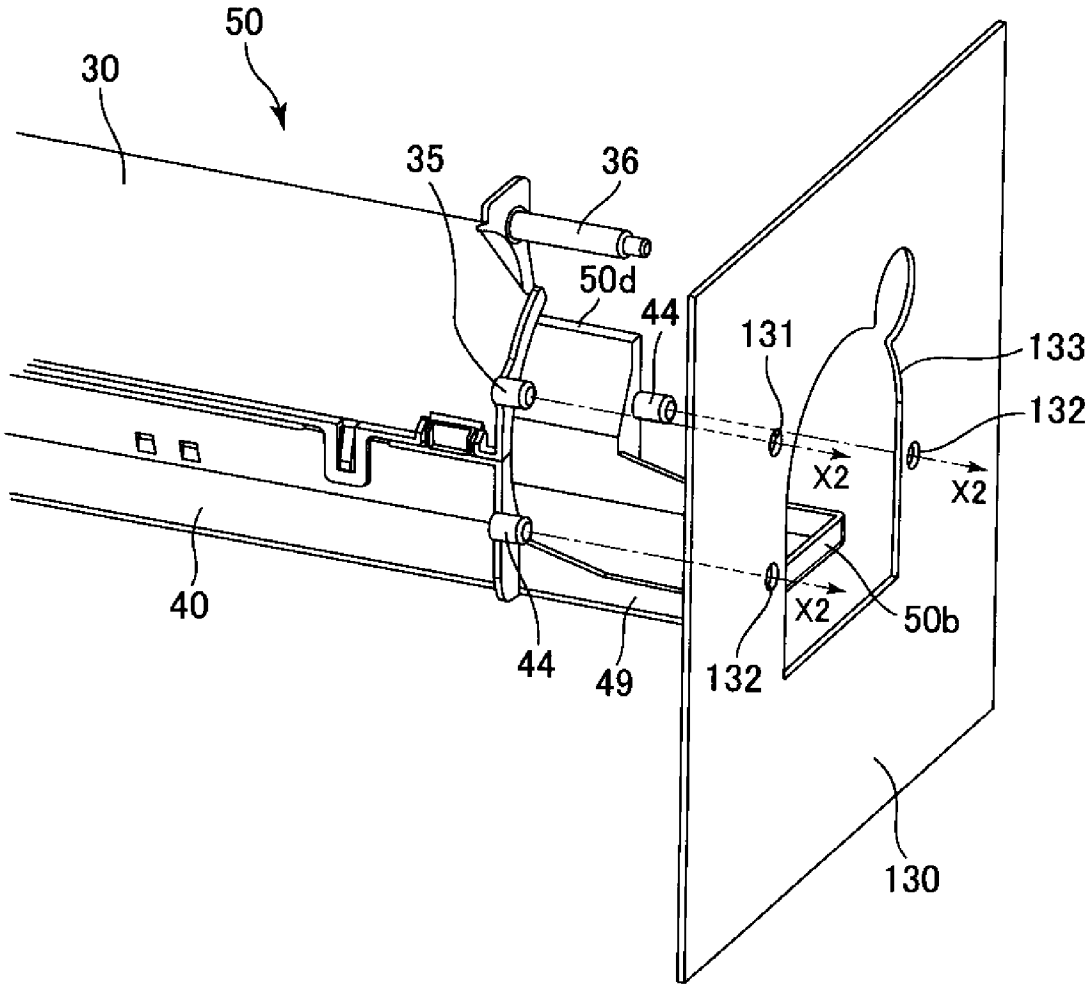
FIG. 6 is a perspective view of one of the lengthwise ends, and its adjacencies, of the developer container holding member in the embodiment.
Figure 7:
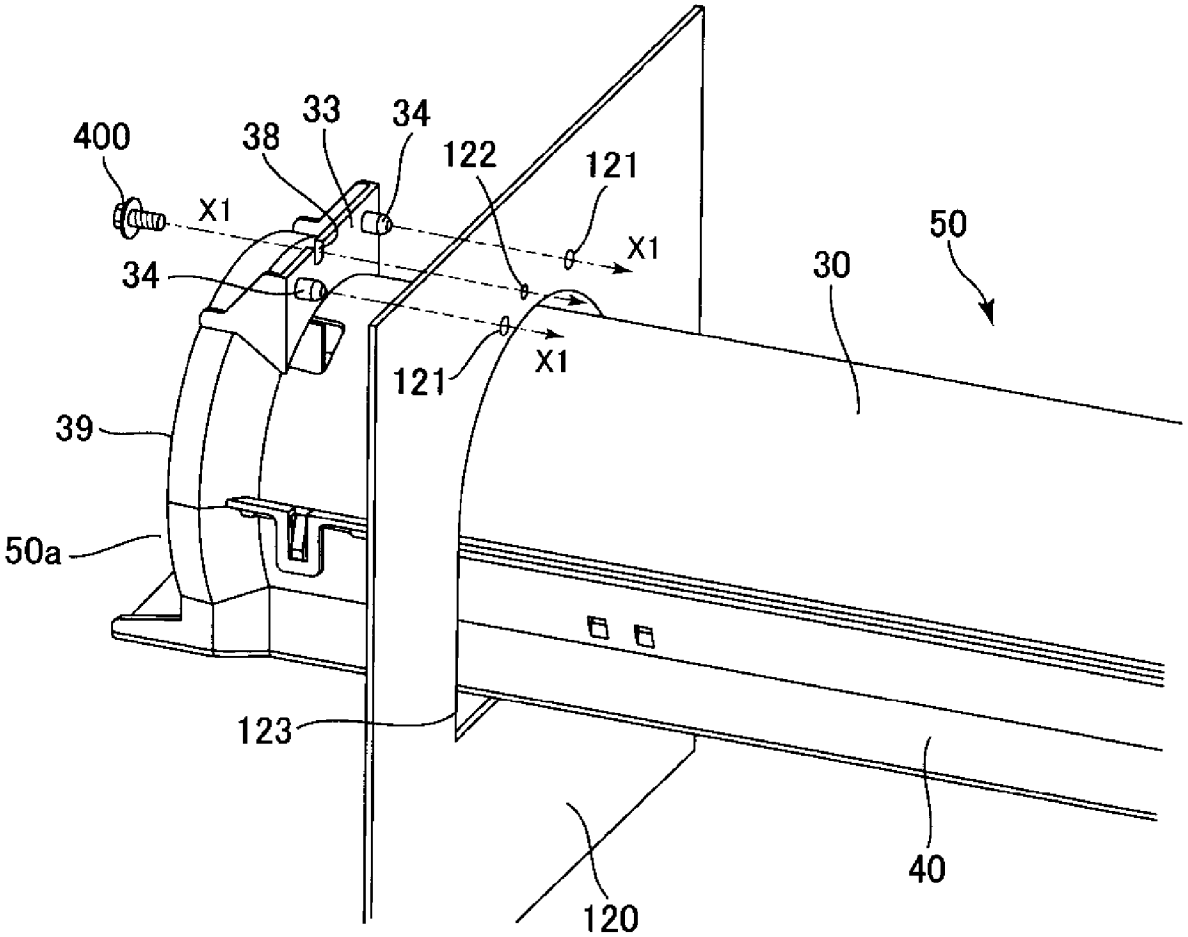
FIG. 7 is a perspective view of the other lengthwise end, and its adjacencies, of the developer container holding member in the embodiment.

FIG. 5 is an exploded perspective view of the holding member 50. FIGS. 6 and 7 are enlarged perspective views of the lengthwise end portions of the holding member 50, one for one. They show the lengthwise end portions of the holding member 5 in detail.

In this embodiment, the lengthwise direction of the holding member 50 is parallel to the axial line of the holding member 50 which extends between the front and rear plates 120 and 130 when the holding member 50 is in suspension between the front and rear plates 120 and 130. It is roughly parallel to the lengthwise direction of the toner container 20 (parallel to rotational axis of toner container 20) when the toner container 20 is in the holding member 50. Hereafter, the lengthwise end of the holding member 50, which is placed on the front plate side, will be referred to as the first end portion 50*a*, whereas the other lengthwise end of the holding member 50, that is, the one which is placed on the rear plate side, will be referred to as the second end portion 50*b*.

In this embodiment, the holding member 50 is made up of the top and bottom members 30 and 40. The top member 30 is in the form of one of the longitudinally split two halves of a cylinder, being roughly semicircular in widthwise cross section. It is positioned so that when the holding member 50 is in suspension between the front and rear plates 120 and 130, it will be the top half of the holding member 50. The bottom member 40 also is in the form of one of the two halves of a longitudinally split cylinder, being roughly semicircular in widthwise cross section. It is positioned so that when the holding member 50 is in suspension between the front and rear plates 120 and 130, it will be the bottom half of the holding member 50.

The procedure for assembling the holding member 50 is as follows. First, the top member 30 is to be moved in the direction (downward) indicated by an arrow mark Z1 in FIG. 5, so that the edge portion (top edge portion) 37 of the top member 30 of the holding member 50, which extends in the lengthwise direction of the holding member 50, aligns with the edge portion (bottom edge portion) 48 of the bottom member 40, which extends in the same direction as the edge portion 37. Then, the engaging portions (engagement protrusions) 45 are to be fitted into the engaging portions (engagement holes) 31 of the top member 31, one for one. These engagements prevent the top and bottom members 30 and 40 from moving relative to each other in the direction indicated by the arrow mark Z. Further, the engaging portions (engagement protrusions) 46 of the bottom member 40 are fitted into the engaging portions (engagement grooves) 32 of the top member 30, one for one, preventing thereby the top and bottom members 30 and 40 from moving relative to each other in their lengthwise direction. Consequently, the combination of the top and bottom members 30 and 40 forms the holding member 50 for holding the toner container 20. That is, as the top and bottom members 30 and 40 are joined as described above, they turn into the holding member 50, which is roughly cylindrical, and the internal space of which is the container storage portion 50*c*, in which the toner container 20 is stored.

Referring to FIG. 6, the second lengthwise end 50*b* of the top member 30 of the holding member 50 is provided with a protruding portion (rear protrusion) 35, which protrudes outward of the holding member 50 in terms of the lengthwise direction of the holding member 50. Further, the second end portion 50*b* of the bottom member 40 of the holding member 50 is provided with a pair of protruding portions (rear protrusions) 44 and 44, which also protrude outward of the holding member 50 in terms of the lengthwise direction of the holding member 50. The procedure for attaching the holding member 50 to the apparatus main assembly 110 is as follows. First, the holding member 50 is to be held, relative to the rear plate 130, in such a manner that the second end portion 50*b* of the holding member 50 partially protrudes rearward beyond the rear plate 130 through the opening (rear opening) 133 with which the rear plate 130 is provided. Then, the holding member 50 is to be moved toward the rear plate 130 in the lengthwise direction of the holding member 50, until the top rear protrusion 35 and pair of bottom rear protrusions 44 and 44 fit into the engaging hole (top rear hole) 131, and pair of engaging holes (bottom rear engagement holes) 132 and 132, respectively, in the direction indicated by an arrow mark X2. The top rear protrusion 35, and bottom rear protrusions 44 and 44, loosely (with the presence of a certain amount of play) fit into the top rear engagement hole 131, and pair of bottom rear engagement hole 132 and 132, respectively. Thus, the holding member 50 is allowed to move relative to the rear plate 130 in the lengthwise direction of the holding member 50. After the proper attachment of the holding member 50 to the apparatus main assembly 110, a part (tray portion 49, in particular) of the second end portion 50*b* of the holding member 50, is protruding rearward beyond the rear plate 130.

On the other hand, referring to FIG. 7, the first end portion 50*a* of the top member 30 of the holding member 50 is provided with a pair of protrusions (front protrusions) 34 and 34, which protrude inward of the holding member 50 in terms of the lengthwise direction of the holding member 50. The next procedure to attach the holding member 50 to the apparatus main assembly 110 is as follows. First, the holding member 50 is to be moved in the direction of the second end portion 50*b* in the lengthwise direction of the holding member 50, in such a manner that the first end portion 50*a* of the holding member 50 remains partially protruding frontward beyond the front plate 120 through the opening (front opening) 123 with which the front plate 120 is provided. Then, the holding member 50 is to be moved in the direction indicated by an arrow mark X1 in the lengthwise direction of the holding member 50, until the pair of front protrusions 34 and 34 fit into the pair of engagement holes (front engagement holes) 121 and 121, with which the front plate 120 is provided. The aforementioned directions indicated by the arrow marks X1 and X2 are parallel to each other. Next, the flat seating surface 33, from which the pair of the aforementioned front protrusions 34 and 34 protrude is placed in contact with the flat surface of the front plate 120. Then, the shaft portion of a small screw 400 as a fastening means is to be put through the groove 38 with which the seating surface portion 33 is provided, and the screw hole 122 with which the front plate 120 is provided. Thus, the top member 30 becomes rigidly fixed to the front plate 120, being prevented from moving relative to the front plate 120. After the attachment of the holding member 50 to the apparatus main assembly 110, a part (in particular, toner container insertion opening 39, which will be described later) of the first end portion 50*a* of the holding member 50 is protuberant frontward beyond the front plate 120.

On the second end side of the holding member 50, the top rear protrusion 35, and pair of bottom rear protrusions 44 and 44, are loosely fitted in the top rear engagement hole 131, and pair of bottom rear engagement holes 132 and 132, respectively, allowing thereby the holding member 50 to move relative to the rear plate 130 in the lengthwise direction of the holding member 50 (FIG. 6). That is, the rear end portion 50*b* of the holding member 50 is not fixed to the rear plate 130 by a fastening means. Therefore, even if the holding member 50 is subjected to such vibrations that are parallel to the lengthwise direction of the holding member 50*s*, the vibrations are not transmitted to the rear plate 130, or attenuate, as long as the vibrations are no stronger than a preset amount.

By the way, the positioning of the above described protruding portions and engagement holes may be opposite from their positioning in this embodiment. More concretely, the combination of the holding member 50 and the front and rear plates 120 and 130 may be structured so that the rear plate 130 is provided with any or all of the top rear protrusion 35 and pair of bottom rear protrusions 44, and the holding member 50 is provided with any or all of the top rear engagement holes 131, and the corresponding bottom rear holes 132 and 132. The same applies to the positioning of the front pair of protrusions 34 and 34, and the front engagement holes 121 and 121.

Figure 8:
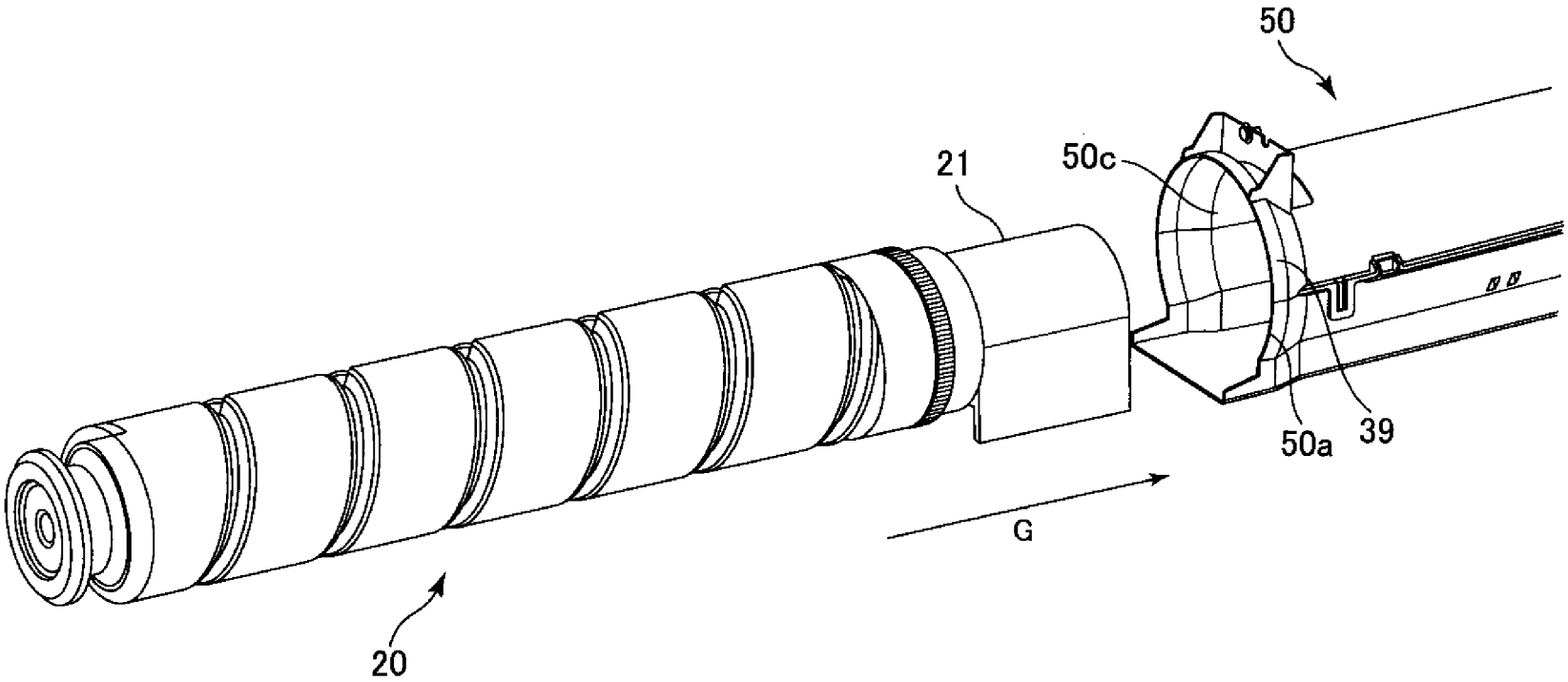
FIG. 8 is a perspective view of the combination of the toner container and toner container holding member in the embodiment, and shows the process for inserting the toner container into the toner container holding member.
Figure 9:
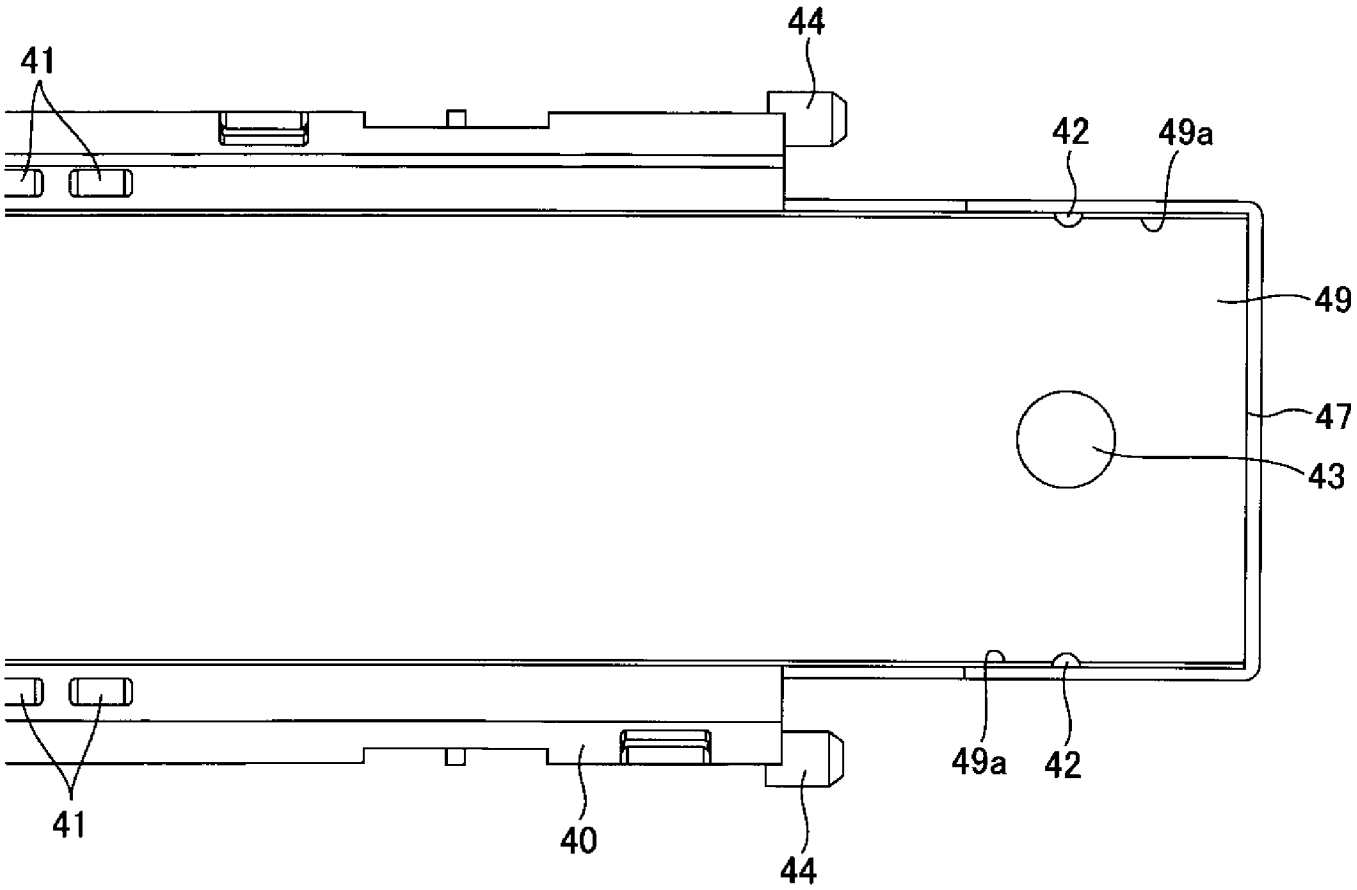
FIG. 9 is a top view of the one of the lengthwise ends, and its adjacencies, of the toner container holding member in the embodiment.
Figure 10:
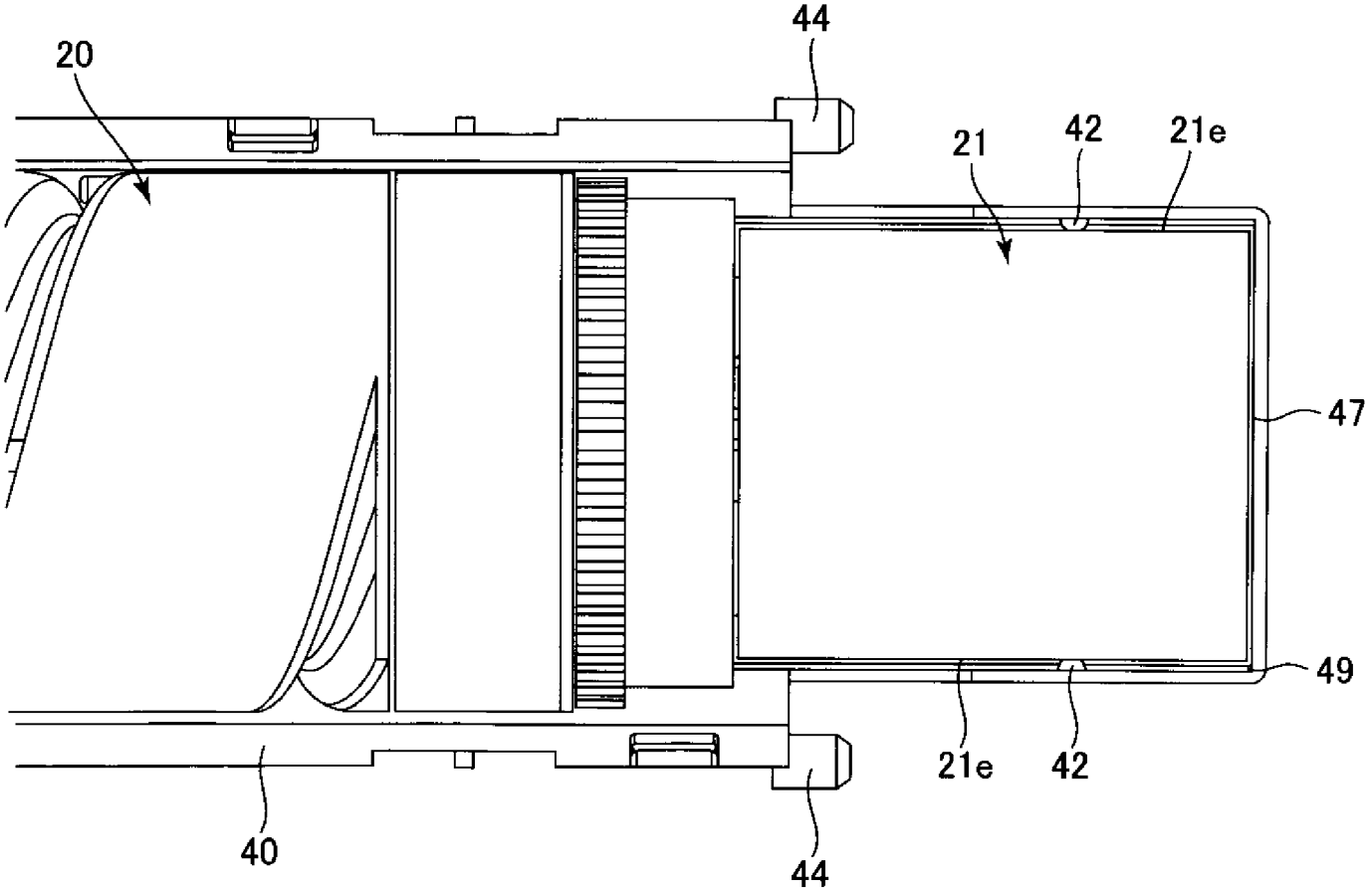
FIG. 10 is a top view of the one of the lengthwise ends, and its adjacencies, of the toner container holding member in the embodiment, when the toner container is in the toner container holding member.

FIG. 8 is a perspective view of the combination of the toner container 20 and holding member 50, and shows how the former is to be installed into the latter. FIGS. 9 and 10 are top views of the second end portion 50*b*, and its adjacencies, of the holding member 50, before and after the installation of the toner container 20 into the holding member 50, respectively.

Referring to FIG. 8, the toner container 20 is to be inserted into the holding member 50 in the apparatus main assembly 110, in the direction indicated by an arrow mark G, in the lengthwise direction of the toner container 20 and holding member 50. That is, the toner container 20 is to be inserted into the container storage portion 50*c* of the holding member 50, toward the second end portion 50*b* of the holding member 50, through the toner container insertion opening 39, with which the first end portion 50*a* of the holding member 50 is provided, in the lengthwise direction of the toner container 20 and holding member 50, in such an attitude that the flange portion 21 becomes the first portion that enters the holding member 50. As the toner container 20 is inserted into the holding member 50 as described above, it becomes removably supported (stored) in the holding member 50. That is, the toner container 20 is removably installed in the apparatus main assembly 110.

By the way, the front of the image forming apparatus 100 is provided with an unshown door, which can be opened to expose the interior of the apparatus main assembly 110 to enable a user (operator) to install or uninstall the toner container 20. That is, in order to install or uninstall the toner container 20, this door has to be opened.

More concretely, the toner container 20 is held by the bottom member 40 of the holding member 50. That is, referring to FIGS. 9 and 10, as the toner container 20 is inserted into the holding member 50, the flange portion 21 of the toner container 20 comes into contact with the toner container catching portion 47 of the tray portion 49 of the bottom member 40, with which the second end portion 50*b* of the holding member 50 is provided, being thereby prevented from entering further into the holding member 50. At the point in time of this contact, a pair of protrusions (retention protrusions 42 which are inwardly protuberant, in terms of the radius direction of the holding member 50, from the inward surface of the second end portion 50*b* of the holding member 50, and have just been elastically deformed by the toner container 20, resiliently press on the corresponding portions 21*e* and 21*e* of the peripheral surface of the flange portion 21 of the toner container 20. Thus, the toner container 20 is positioned relative to the holding member 50. As the toner container 20 is positioned relative to the holding member 50, a connective hole 43, with which the tray portion 49 of the bottom member 40 is provided, becomes aligned with the toner outlet opening 21*a* of the toner container 20, in such a manner that the connective hole 43 becomes coaxial with the toner outlet 21*a*, making it possible for the toner supplying device 70 to be supplied with the toner from the toner container 20.

Referring to FIG. 2, in this embodiment, the image forming means driving device 90 is disposed nearer to the rear plate 130 than the front plate 120. Further, the image forming means driving device 90 is fixed to the rear plate 130, that is, the one by which the holding member 50 is movably supported.

To elaborate, the toner in the toner container 20 is conveyed within the toner container 20 in the lengthwise direction of the toner container 20. Therefore, the vibrations attributable to the toner conveyance in the toner container 20 travel in the lengthwise direction of the toner container 20, and reaches the holding member 50. Then, the vibrations travel through the holding member 50 in the lengthwise direction of the holding member 50. Further, in particular, in this embodiment, the pumping portion 20*b* of the toner container 20 is in the adjacencies of the rear plate 130, and expands or contracts in the lengthwise direction of the toner container 20. Therefore, the vibrations attributable to the expansion or contraction of the pumping portion 20*b* travels to the holding member 50, and then, travel further through the holding member 50 in the lengthwise direction of the holding member 50.

In this embodiment, however, the holding member 50 which holds the toner container 20 is not immovably attached to the rear plate 130. That is, the holding member 50 is allowed to move relative to the rear plate 130 in its lengthwise direction as described above. Thus, even when the holding member 50 is subjected to a certain amount of vibrations which travel in the lengthwise direction of the holding member 50, the vibrations do not travel to the rear plate 130, or attenuates as it travels toward the rear plate 130. Therefore, it is possible to prevent the vibrations from spreading to the various elements of the image forming means fixed to the rear plate 130, and the image forming means driving device 90 which also is fixed the rear plate 130. In particular, from the standpoint of preventing the image forming apparatus 100 from outputting an unsatisfactory image, the unsatisfactoriness of which is attributable to the above described vibrations, it is important to prevent the vibrations from traveling to the image forming means driving device 90 which transmits driving force to at least one (both in this embodiment) of the photosensitive drum 1 and developing device 4 of the image forming means. Further, the above described vibrations attenuate as they travel from the bottom member 40 of the holding member 50 to the top member 30 of the holding member 50, and then, to the front plate 120. Therefore, it is possible to prevent the vibrations from reaching the various elements of the image forming system fixed to the front plate 120. Typical ones among various elements of the image forming means, which vibrations are prevented from reaching are photosensitive drum 1 and developing device 4 with which the image forming means is equipped.

As described above, in this embodiment, the image forming apparatus 100 has the first and second frames 120 and 130, respectively, which oppose each other across the apparatus main assembly 110. The image forming apparatus 100 has an image forming means P has an image forming means P which forms an electrostatic image on the image bearing member 1 and developing the electrostatic image with the use of the combination of the developing device 4 and developer. Further, image forming apparatus 100 has the first driving device (image forming means driving device) 90 which transmits driving force to at least one of the image bearing member 1 and developing device 4. Further, it has the holding member 50 which holds the developer container 20 in which the developer to be supplied to the developing device 4 is stored. It has the second driving device (container driving device) 80 which transmits driving force to the developer container 20 held by the holding member 50. The holding member 50 is immovably attached to the first frame (front plate) 120, by one (first end side) of its lengthwise end portions, in terms of the direction parallel to the aforementioned axial line which extends between the first and second frames 120 and 130. As for the other lengthwise end portion (second end 50*b* side) in terms of the above described axial line, it is supported by the second frame (rear plate) 130 in such a manner that the holding member 50 (lengthwise end portion) is allowed to move relative to the second frame 130 in the direction parallel to the above described axial line. The first driving device 90 is disposed closer to the second frame 130 than the first frame 120. It should be noted here that in this embodiment, the first driving device 90 is rigidly attached to the second frame 130. However, it is not mandatory that the first driving device 90 is rigidly attached to the second frame 130. It should be also noted that this embodiment is effective, in particular, when the distance by which the vibrations have to travel to reach the first driving device 90 through the second frame 130 is shorter than the distance by which the vibrations have to travel to reach the driving device 90 through the first frame 120.

In this embodiment, the developer in the developer container 20 is conveyed toward the developer outlet 21*a* of the developer container 20 in the direction parallel to the above described axial line direction. Of the first and second frames 120 and 130, the second frame 130 is on the downstream side of the first frame 120 in terms of the direction in which the developer in the developer container 20 is conveyed in the developer container 20. The driving force receiving portion 20*a* which receives driving force from the second driving device 80 when the developer container 20 is in the holding member 50 is disposed closer to the second frame 130 than the first frame 120. In particular, in this embodiment, as driving force is transmitted to the developer container 20 from the second driving device 80, at least a part of the developer container 20 reciprocally moves in the direction parallel to the above described axial line. The expanding-contracting portion 20*b* which expands or contracts in the direction parallel to the abovementioned axial line to make at least a part of the developer container 20 reciprocally move is closer to the second frame 130 than the first frame 120.

In particular, in this embodiment, the lengthwise end portion of the holding member 50, which is on the second frame side, is provided with the protrusions 35, 44 and 44, which protrude in the direction parallel to the above-described axial line. The second frame 130 which opposes the holding member 50 is provided with the holes 131, 132 and 132, in which the protrusions 35, 44 and 44 are movably fitted. As these protrusions are inserted into the corresponding holes in the direction parallel to the above-described axial line, the lengthwise end portion of the holding member 50, which is on the second frame side, is movably held by the second frame 130. Further, the lengthwise end portion of the holding member 50, which is on the first frame side, is rigidly fastened to the first frame 120 with the fastening means, being thereby immovably attached to the first frame 120. However, the choice of the fastening means does not need to be the one in this embodiment. That is, it is optional. It may be gluing, welding, snap-fit, etc., for example.

Further, in this embodiment, the image forming apparatus 100 has multiple holding members 50, which are independent from each other, and are independently suspended by the first and second frames 120 and 130.

Therefore, according to this embodiment, the vibrations caused in the direction parallel to the axial line of the holding member 50 by the transmission of driving force to the developer container 20 attenuate while they travel through the holding member 50, being therefore unlikely to reach various elements, in particular, the image forming means driving device 90, of the image forming means. Further, the multiple holding members 50 are independently suspended by the first and second frames 120 and 130, being thereby unlikely to be made sympathetically resonate with each other by the transmission of driving force to the multiple developer containers 20 in the multiple holding members 50 one for one. Therefore, it is possible to prevent the image forming apparatus 100 from outputting an unsatisfactory image, the unsatisfactoriness of which is attributable to the vibrations.

4. Driving Force Transmission To Toner Container

Next, the method for transmitting driving force to the toner container 20 to cause the toner container 20 to discharge the toner therein is described.

Figure 11:
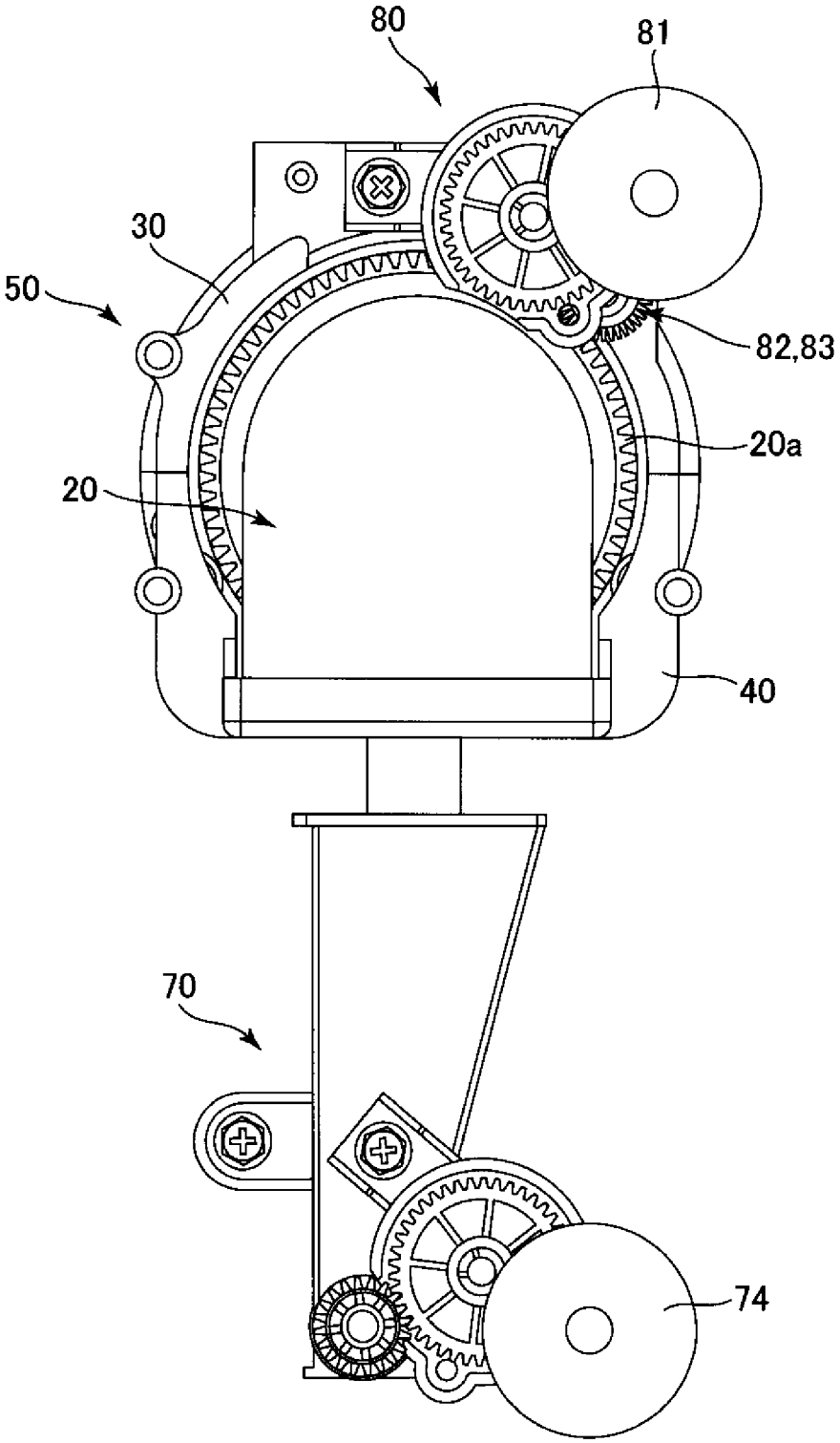
FIG. 11 is a side view of one of the lengthwise ends of the toner container holding member in the embodiment, as seen from the rear side of the holding member.
Figure 12:
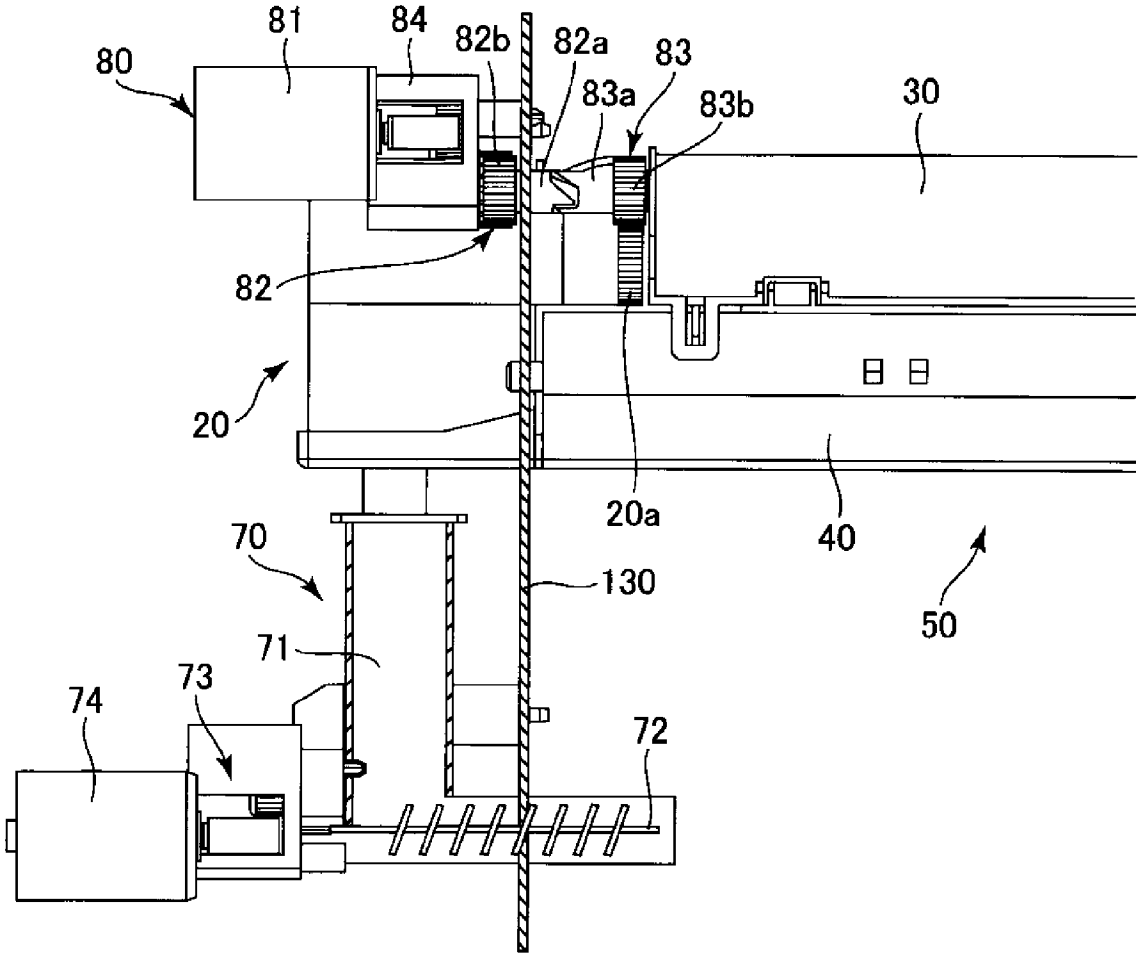
FIG. 12 is a schematic, and partially sectional, side view of one of the lengthwise ends of the toner container in the embodiment, as seen from the left side of the holding member.

FIG. 11 is a side view of the holding member 50 as seen from the rear side of the apparatus main assembly 110 (rear plate 13 is not shown). FIG. 12 is a partial sectional side view of the holding member 50 as seen from the left side of the apparatus main assembly 110.

In this embodiment, the container driving device 80 as a driving force transmitting mechanism is rigidly fastened to the rear plate 130. The container driving device 80 has: a bottle driving motor as a driving force source; and a gear train 84 as a driving force transmitting means for speed reduction. The last stage of the gear train 84 in terms of the driving force transmission direction is provided with the first coupling gear 83 as the first connective means. That is, the first coupling gear 82 is attached to the rear plate 130 with the placement of the container driving device 80 between itself and rear plate 130.

As for the second coupling gear 83 as the second connective means, it is rotatably attached to the coupling shaft 36 (FIG. 6) which projects from the lengthwise end of the top member 30, which is on the second end 50*b* side of the holding member 50. That is, the second coupling gear 83 is attached to the holding member 50.

The coupling portion 82*a* of the first coupling gear 82 is engaged with the coupling portion 83*a* of the second coupling gear 83 to transmit the driving force. The gear portion 82*b* of the first coupling gear 82 is in engagement with a higher gear of the gear train 84. As the toner container 20 is inserted into the holding member 50, the gear portion 83*b* of the second coupling 83 becomes engaged with the gear portion 20*a* of the toner container 20, through the opening (driving force transmission opening) 50*d* of the holding member 50 (FIGS. 5 and 6). The first and second coupling gears 82 and 83 rotate about the rotational axis which is roughly parallel to the lengthwise direction of the holding member 50. Thus, even if the holding member 50 moves in its lengthwise direction by a certain amount, and this movement of the holding member 50 causes the second coupling gear 83 to move relative to the first coupling gear 82 by the certain amount in the same direction, the first and second coupling gears 82 and 83 remain engaged with each other.

Since the driving force transmitting mechanism is structured as described above, it is possible for the driving force from the bottle driving motor 81, to be transmitted to cause the toner container 20 to discharge the toner therein.

In this embodiment, the first and second coupling gears 82 and 83 structured as described above are used to transmit the driving force. Therefore, the vibrations traceable to the toner container 20 can be prevented from being transmitted to the rear plate 130 through the container driving device 80. That is, the second coupling gear 83 is movable relative to the first coupling gear 82 by a preset amount, as described above. Therefore, even if the vibrations from the toner container 20 are transmitted to the holding member 50, these vibrations are prevented from being transmitted from the first and second coupling gears 82 and 83 to the rear plate 130 through the container driving device 80. Therefore, it is possible to prevent the vibrations from being transmitted to the image forming means driving device 90 which is rigidly attached to the rear plate 130.

Incidentally, in this embodiment, in order to minimize the transmission of the vibrations to the rear plate 130, the container driving device 80 is rigidly fastened to the rear plate 130. However, the container driving device 80 may be fastened to the holding member 50. With the employment of this structural arrangement, it is also possible to prevent the vibrations from traveling to the image forming means driving device 90.

As described above, in this embodiment, the second driving device (container driving device) 80 is disposed closer to the second frame (rear plate) 130 than to the first frame (front plate) 120. In particular, in this embodiment, the second driving device 80 is rigidly fixed to the second frame 130. However, it is not mandatory that the second driving device 80 is rigidly attached to the second frame 130. That is, this embodiment is particularly effective in a case where the distance which the vibrations have to travel to reach the second frame 130 is shorter than the distance which the vibrations have to travel to reach the first frame 120. Also in this embodiment, the driving force from the second driving device 80 is transmitted to the developer container 20 through the combination of the first and second driving force transmitting means 82 and 83 which are engaged in such a manner that they are movable relative to each other in the direction parallel to the axial line of the holding member 50. Further, the first and second driving force transmitting means 82 and 83 can transmit driving force even if they move relative to each other when the holding member 50 is held by the first and second frames 120 and 130. Moreover, the second driving device 80 may be rigidly fixed to the holding member 50.

In this embodiment, a CPU 150 (FIG. 1) determines the timing with which the rotation of the bottle driving motor 81 is to be started, length of time the bottle driving motor 81 is to be operated, and the speed at which the bottle driving motor 81 is to be operated, based on the toner density set for the image to be formed, or the like factor, and sets the bottle driving motor 81 accordingly. Consequently, a proper amount of toner is discharged from the toner container 20 into the toner supplying device 70.

The toner supplying device 70 is made up of a storage portion 71, a toner conveyance motor 74 as a driving force source, a gear train 73, a screw which is mechanically in connection with the gear train 73, etc. The storage portion 71 can internally store toner. In this embodiment, the toner supplying device 70 is rigidly fixed to the rear plate 130. As the toner conveyance motor 74 is driven in synchronism with the image forming means driving device 90 as described above, the toner in the toner supplying device 70 is conveyed to the developing device 4. Thus, the image forming apparatus 100 is enabled to form an image while its developing device 4 is kept stable in toner density (ratio of toner relative to developer) at a preset level.

As will be evident from the detailed description of this embodiment, this embodiment can prevent the problem that the vibrations attributable to the transmission of driving force to the developer container 20 travel to the image forming means, and/or the driving device 90 from which driving force is transmitted to the image forming means. Therefore, this embodiment can prevent the image forming apparatus 100 from outputting an unsatisfactory image, the unsatisfactoriness of which is attributable to the vibrations generated by the transmission of driving force to the developer container 20.

Miscellaneous Embodiments

In the foregoing, the present invention was described with reference to one of the embodiments of the present invention. However, the embodiment is not intended to limit the present invention in scope.

For example, the developer to be used by the developing device may be magnetic or nonmagnetic single-component toner. Further, the primary colors of which a full-color image is to be effected do not need to be limited to four, and the order in which monochromatic color images, different in color, are formed does not need to be limited to the order in the above described embodiment.

Further, the developer container does not need to be structured so that as it is rotated, at least a part of it reciprocally moves. For example, the developer container may be structured so that as it is rotated, the toner in it is stirred and/or conveyed in the direction parallel to the rotational axis of the container by a spiral protrusion on the inward surface of the container. Further, it is not mandatory that the image forming apparatus 100 is structured so that the developer container is rotated. For example, the developer container may be provided with an internal stirring member and/or a toner conveying member, which is rotated by the driving force transmitted thereto from the container driving device.

Further, it is not mandatory that the image forming means driving device transmits driving force to both the photosensitive member and developing device. For example, the image forming apparatus may be provided with an image forming means driving device which transmits driving force to only the photosensitive member, and an image forming means driving device which transmits driving force to only the developing device.

According to the present invention, it is possible to prevent the problem that the vibrations attributable to the transmission of mechanical driving force to a developer container travel to image forming means, and/or driving device which transmits mechanical driving force to the image forming means.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 277135/2012 filed Dec. 19, 2012, which is hereby incorporated by reference.

What is claimed is:

1. An image forming apparatus comprising;

an image forming station including an image bearing member for bearing a latent image and a developing device configured to develop the latent image formed on said image bearing member using toner;

a toner container configured to accommodate toner to be supplied to said developing device, said toner container being provided with an expansion-and-contraction portion capable of being expanded and contracted in a longitudinal direction thereof by being driven;

a holding member configured to hold said toner container;

a first side plate provided at one end side of said holding member with respect to the longitudinal direction and configured to support one end portion of said holding member;

a second side plate provided at the other end side of said holding member with respect to the longitudinal direction and configured to support the other end portion of said holding member; and a driving device configured to drive said image forming station, wherein said driving device is provided on said first side plate, wherein said holding member is supported by said first side plate so as to be movable relative to the first side plate in the longitudinal direction and is fixed to said second side plate, and wherein said first and second side plates face each other.

2. An apparatus according to claim 1, wherein one of said first side plate and said holding member is provided with a projection projecting in the longitudinal direction, and the other is provided with an engaging hole with which said projection movably engages.

3. An apparatus according to claim 1, further comprising a driving source fixed to said first side plate.

4. An apparatus according to claim 1, further comprising a first drive connection member and a second drive connection member provided in a drive transmission path between said driving source and said toner container, wherein said first drive connection member and said second drive connection member are engaged with each other so as to be movable in the longitudinal direction.

5. An apparatus according to claim 1, wherein said expansion-and-contraction portion is disposed at a position closer to said first side plate than to said second side plate.

6. An apparatus according to claim 1, wherein said first side plate is disposed in a rear side of a main assembly of said apparatus, and said second side plate is disposed in a front side of said main assembly.

7. An image forming apparatus comprising;

an image forming portion configured to form an image, said image forming portion including a developing device configured to develop a latent image with toner;

a pair of side plates including a first side plate and a second side plate opposed to each other, said pair of side plates supporting said image forming portion;

a detachably mounted bottle configured to supply the toner into said developing device, said bottle being provided with a pump portion which is expandable and contractable by being driven to discharge the toner out of said bottle, wherein a direction of the expansion and contraction crosses with said pair of side plates in a position where said bottle is mounted;

a holding portion configured to hold said bottle; and a driving device configured to drive said developing device, wherein said driving device is mounted to said second side plate, and wherein said holding portion is fixed to said first side plate and is supported by said second side plate so as to be movable relative to said second side plate in the direction of the expansion and contraction.

8. An apparatus according to claim 7, wherein one of said second side plate and said holding portion is provided with a projection extending in the expansion and contracting direction, and the other is provided with an engaging hole movably engaged with said projection.

9. An apparatus according to claim 7, further comprising a driving source configured to drive said bottle, and said driving source being mounted to said second side plate.

10. An apparatus according to claim 7, wherein a driving force is transmitted to said bottle from said driving source through a first drive connection member and a second drive connection member engaged with each other movably in the expansion and contraction direction.

11. An apparatus according to claim 7, wherein said pump portion is disposed in a position closer to said second side plate than to said first side plate.

12. An apparatus according to claim 7, wherein said first side plate is disposed in a rear side of a main assembly of said apparatus, and said second side plate is disposed in a front side of said main assembly.

13. An image forming apparatus comprising:

an image forming portion configured to form an image, said image forming portion including a developing device configured to develop a latent image with toner;

a pair of side plates including a first side plate and a second side plate opposed to each other, said pair of side plates supporting said image forming portion;

a detachably mounted bottle configured to supply the toner into said developing device, said bottle being provided with a pump portion which is expandable and contractable by being driven to discharge the toner out of said bottle, wherein a direction of the expansion and contraction crosses with said pair of side plates in a position where said bottle is mounted;

a holding portion configured to hold said bottle; and a driving device configured to drive said developing device, wherein said driving device is mounted to said second side plate, wherein said holding portion is fastened to said first side plate and is supported by said second side plate without being fastened to said second side plate.

14. An apparatus according to claim 13, wherein one of said second side plate and said holding portion is provided with a projection extending in the expansion and contracting direction, and the other is provided with an engaging hole movably engaged with said projection.

15. An apparatus according to claim 13, further comprising a driving source configured to drive said bottle, and said driving source being mounted to said second side plate.

16. An apparatus according to claim 13, wherein a driving force is transmitted to said bottle from said driving source through a first drive connection member and a second drive connection member engaged with each other movably in the expansion and contracting direction.

17. An apparatus according to claim 13, wherein said pump portion is disposed in a position closer to said second side plate than to said first side plate.

18. An apparatus according to claim 13, wherein said first side plate is disposed in a rear side of a main assembly of said apparatus, and said second side plate is disposed in a front side of said main assembly.

* * * * *